US007980016B2

(12) United States Patent
L'Hotel

(10) Patent No.: US 7,980,016 B2
(45) Date of Patent: Jul. 19, 2011

(54) DISPLAY STAND HAVING INVISIBLE SECURING FLAPS

(76) Inventor: Francois L'Hotel, Larchant (FR)

( * ) Notice: Subject to any disclaimer, the term of this patent is extended or adjusted under 35 U.S.C. 154(b) by 247 days.

(21) Appl. No.: 12/099,266

(22) Filed: Apr. 8, 2008

(65) Prior Publication Data

US 2008/0257843 A1 Oct. 23, 2008

(30) Foreign Application Priority Data

Apr. 18, 2007 (FR) ..... 07 02817

(51) Int. Cl.
*G09F 15/00* (2006.01)

(52) U.S. Cl. ..... 40/610; 40/539

(58) Field of Classification Search ..... 40/124.07, 40/124.09, 124.14, 539, 606.12, 606.18, 40/610, 750, 787, 650, 738; 248/174, 459; 229/107, 92.8; 160/135, 352; 383/127
See application file for complete search history.

(56) References Cited

U.S. PATENT DOCUMENTS

| | | | | |
|---|---|---|---|---|
| 1,545,771 | A * | 7/1925 | Hout | 229/107 |
| 1,576,672 | A * | 3/1926 | Miller | 229/107 |
| 1,632,185 | A * | 6/1927 | Jenner | 248/459 |
| 2,428,772 | A * | 10/1947 | Aranoff | 40/789 |
| 2,591,276 | A * | 4/1952 | Middleton et al. | 229/107 |
| 2,845,733 | A * | 8/1958 | Fox | 40/750 |
| 2,975,905 | A * | 3/1961 | Foland | 211/50 |
| 2,991,699 | A * | 7/1961 | Murray, Sr. | 116/63 R |
| 3,759,477 | A * | 9/1973 | Hird | 248/459 |
| 4,825,572 | A * | 5/1989 | Altman Robbins et al. | 40/773 |
| 4,977,697 | A * | 12/1990 | Genick | 40/610 |
| 6,347,772 | B1 * | 2/2002 | L'Hotel | 248/174 |
| 7,159,351 | B2 * | 1/2007 | Sparkowski | 40/610 |
| 7,178,778 | B2 * | 2/2007 | Lee | 248/459 |
| 7,437,842 | B2 * | 10/2008 | Sgambellone | 40/539 |
| 2002/0171023 | A1 * | 11/2002 | L'Hotel | 248/560 |
| 2006/0038393 | A1 * | 2/2006 | Sgambellone | 281/15.1 |

FOREIGN PATENT DOCUMENTS

| | | |
|---|---|---|
| FR | 2760880 A | 9/1998 |
| FR | 2795217 A | 12/2000 |
| FR | 2824946 A | 11/2002 |

* cited by examiner

*Primary Examiner* — Darnell M Jayne
*Assistant Examiner* — Patrick Hawn
(74) *Attorney, Agent, or Firm* — Duane Morris LLP; J. Rodman Steele, Jr.; Gregory M. Lefkowitz

(57) ABSTRACT

Stand for displaying information having at least one presentation surface, comprising a plurality of panels (32-34) made of a substantially rigid material and articulated together in an articulation direction, having two end panels (32, 34) each extending between an articulation edge (35, 36) and a free border (37, 38) substantially parallel to the articulation edge (35, 36), the stand being able to be laid flat counter to the action of elastic return means, with the two free borders (37, 38) of the two end panels (32, 34) being spaced apart from one another. The return means are arranged in order, after the panels have been unfolded, to bring the two free borders (37, 38) together, so as to be approximately coincident, and to thus set up the stand. The width of one of the end panels between its articulation edge and its free border is different from the rest of the opened-out width of the stand, each of the two end panels being extended by flaps (39, 40) for securing the elastic return means, these flaps being articulated at the free border (19, 20) and flapped inwards. When the stand is set up, the flaps for securing the two end panels are flattened together between the two end panels.

13 Claims, 8 Drawing Sheets

DISPLAY STAND HAVING INVISIBLE SECURING FLAPS

CROSS REFERENCE TO RELATED APPLICATIONS

This application claims priority to French Patent Application Number 0702817 filed Apr. 18, 2007, the entirety of which is incorporated herein by reference.

FIELD OF THE INVENTION

The field of the invention is that of information display stands for visual advertising or communication in sales locations, known as point-of-sale displays. The display stands of the invention are columns which can be folded together and unfolded virtually automatically, having the advantage firstly of being able to be transported and stored under excellent conditions and secondly of being installed on site very rapidly.

BACKGROUND

Starting from a folded-up state, it is necessary merely to begin unfolding the stand for it to completely unfold automatically under the action of elastic return means. Of course, in contrast, folding up the stand takes place counter to the action of the elastic return means.

Document FR-2824946 discloses a stand for displaying information having a presentation surface, comprising a foldable panel of substantially rigid material comprising the said presentation surface, elastic return and straining means for bulging out the presentation surface of the panel and a plurality of inserts to hold the presentation surface of the panel in the bulged-out state, in opposition to the elastic straining means.

In this prior art stand, when the stand is set up the holding strips, or inserts, extend inside the stand.

SUMMARY OF THE INVENTION

The Applicant has sought to provide a stand in which the interior space in the set-up state is left free in order for an object to be able to slide therein or for the stand to be able to slide around an object which may or may not jut out from the stand. The object may have an advertising purpose or may have a purely physical purpose of maintaining the stability of the stand if, in the set-up state, the area of the base is too small.

Thus, the invention relates to a stand for displaying information having at least one presentation surface, comprising a plurality of panels made of a substantially rigid material and articulated together in an articulation direction, having two end panels each extending between an articulation edge and a free border substantially parallel to the articulation edge, the stand being able to be laid flat counter to the action of elastic return means, with the two free borders of the two end panels being spaced apart, i.e., separated, from one another and the panels thus being able to be folded together, the return means being arranged in order, after the panels have been unfolded, to bring the two free borders together, so as to approximately coincident, and thus to set up the stand, the width of one of the end panels between its articulation edge and its free border being different from the rest of the opened-out width of the stand, each of the two end panels being extended by flaps for securing the elastic return means, these flaps being articulated at the free border and flapped inwards such that, when the stand is set up, the flaps for securing the two end panels are flattened together between the two end panels.

"Panel" should be understood to mean a relatively rigid element made of fairly light cardboard or card, or even plastic, extending between two articulation edges, or one articulation edge and a free border if it is an end panel, on the one hand, and two transverse borders, on the other. It may be an isolated element or part of a larger panel, the element in question then being obtained after the larger panel has been folded along one or two articulation edges.

"Opened-out width of the stand" should be understood to mean the sum of the widths of all the panels of the stand, the width in question being between the two articulation edges or between the articulation edge and the free border when it is an end panel. The rest of the opened-out width is thus equal to this opened-out width minus the width of the end panel in question.

It should immediately be noted that when the stand of the invention is opened out the articulation edge is not equidistant from the two free borders.

It should further be noted that as soon as the two free borders of the stand are spaced apart, i.e., separated, from one another the return means are strained and that, by their action, the stand is set up so that it can be erected on a polygonal base formed by contiguous transverse borders of the panels which are not flapped together.

Since the stand of the invention does not have any interior holding inserts, but rather just interior securing flaps, in addition to its sought-after functional advantage, it has a particularly modest manufacturing cost.

It is observed that while the Applicant effectively wanted to modify and improve the stand of document FR 2 824 946, the stand of the present application also differs from that of document FR 2 760 880 in that, in the set-up state, the securing flaps for the elastic means, just like securing lugs or indentations for the elastic means, are concealed, which gives the stand of the present application a much more attractive exterior appearance. Moreover, the useful presentation area is greatly increased.

Preferably, as many flaps, articulated to each end panel free border and flapped inwards against this end panel, are provided as there are panel boards able to be flapped together.

As a particular application of the stand of the invention, it could be used as an end display for presenting products in a commercial sales area or as anti-theft gateway linings in such an area or any other shop.

In a preferred embodiment of the stand of the invention, it has two articulated panels having different widths.

In this case, in the set-up state, the wider panel bulges out under the action of the elastic return means.

The stand of the invention may comprise three panels, with the width of each end panel being less than the sum of the widths of the other two panels or with the width of one of the two end panels being greater than the sum of the widths of the other two panels.

In this case, in the set-up state, the transverse borders of the panels on either side form a triangular erection/bearing base.

The stand of the invention may also comprise three panels having two end panels with the same width.

The elastic return means may advantageously comprise as many elastic bands secured to flaps as there are panel boards able to be flapped together.

It is also possible to envisage a single elastic band for the two end panels.

BRIEF DESCRIPTION OF THE DRAWINGS

The invention will be better understood with the aid of the following description of several embodiments of the stand of the invention, with reference to the appended drawing, in which.

DETAILED DESCRIPTION

Figure 1:
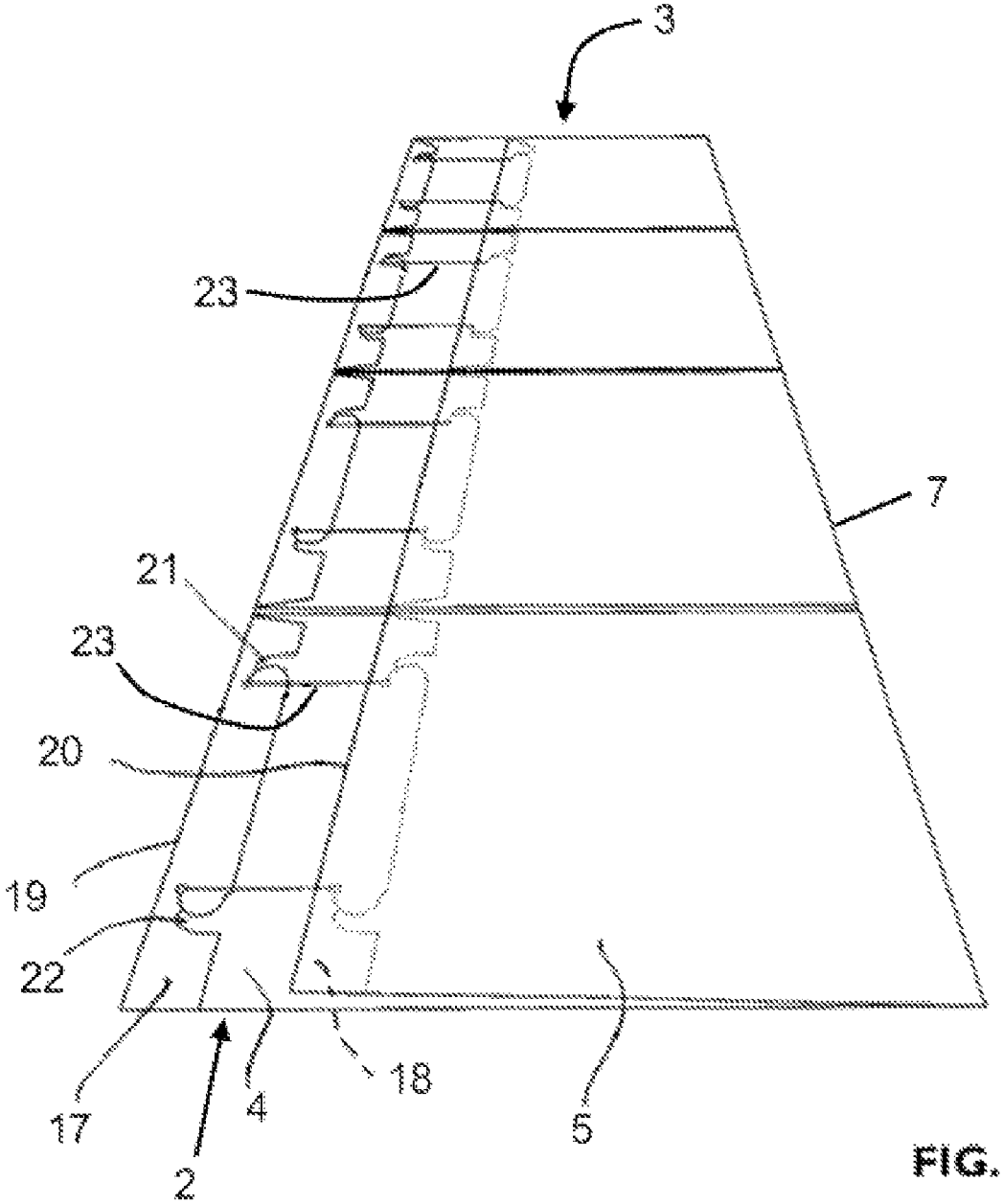
FIG. 1 shows a perspective view of a first embodiment of the stand of the invention having two panels articulated together, laid flat.
Figure 2:
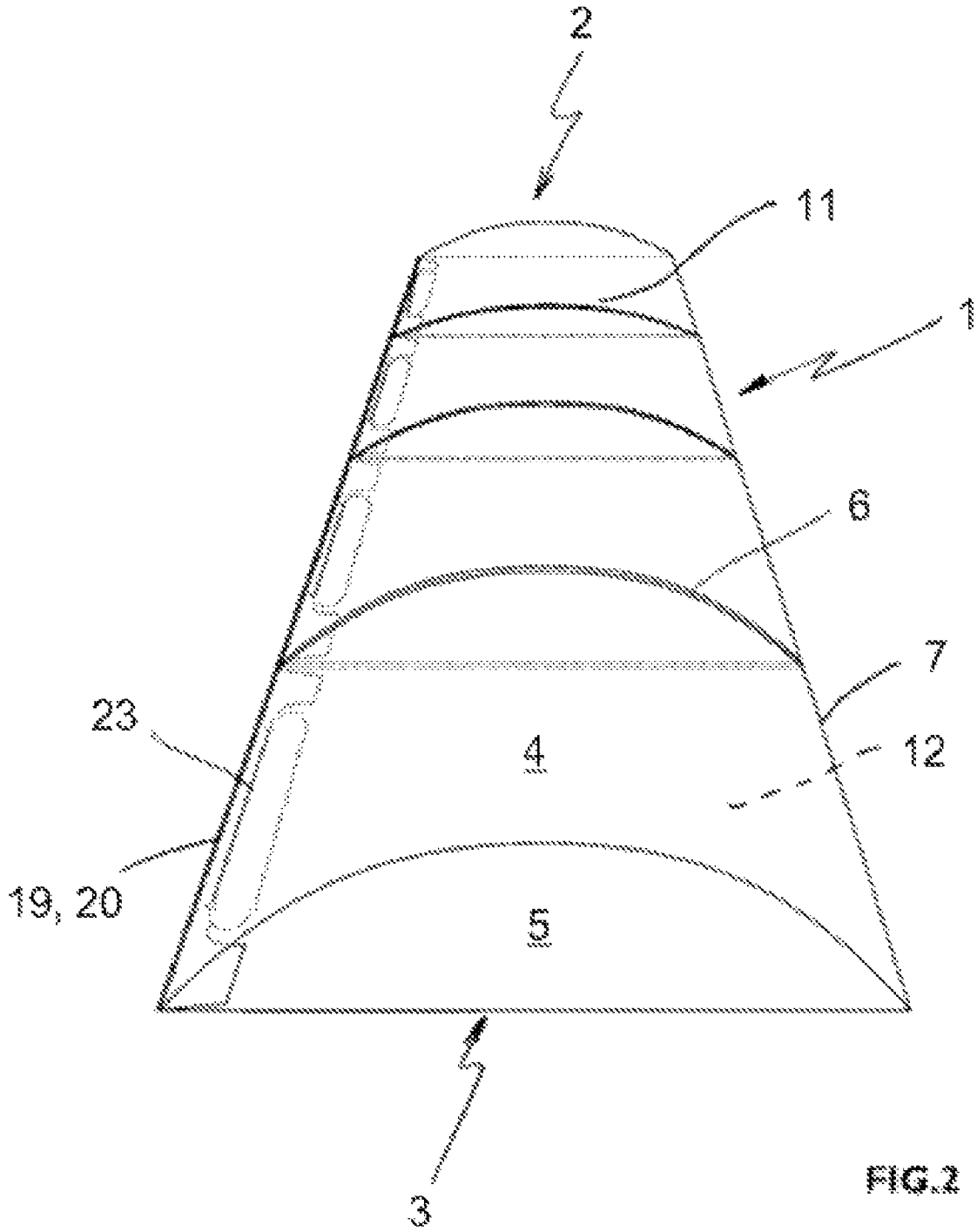
FIG. 2 shows a perspective view of the stand of FIG. 1 in the set-up state.
Figure 3:
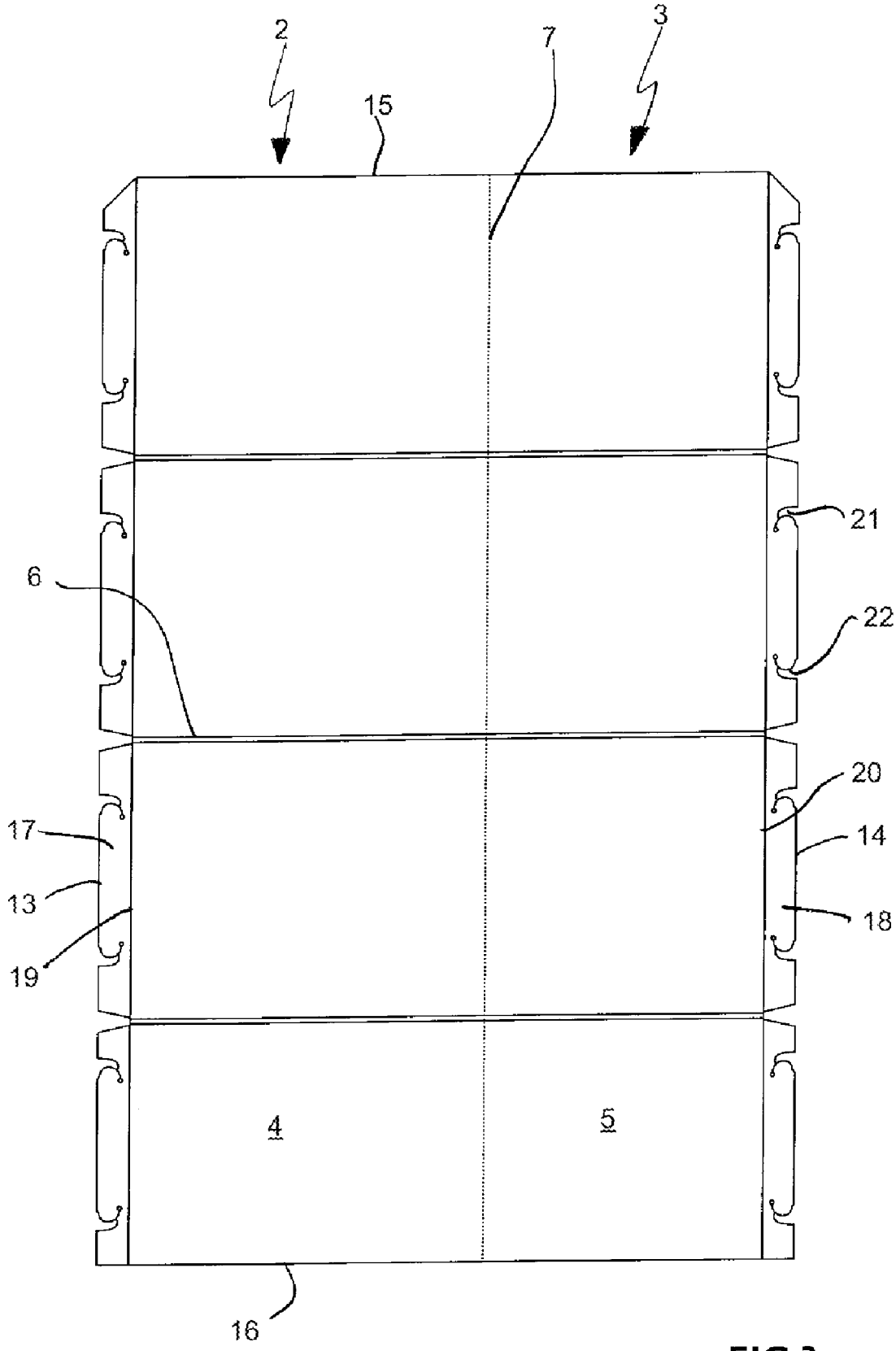
FIG. 3 shows a plan view of the stand of FIGS. 1 and 2 in the opened-out state and laid flat.

The display stand of FIGS. 1-3 is formed from a singular starting panel of fairly light cardboard or card, which is a rigid and foldable material, and comprises two panel parts 2, 3 separated by a folding line 7 forming an articulation edge. Each panel part 2, 3 is divided into boards 4, 5, in this case four, which are adjacent to each other along thick folding lines 6, in this case therefore three. All the boards 4, 5 are identical to one another. It is the front surfaces of the boards 4, 5 which, when the stand is set up as a column 1 (FIG. 2), constitute the information presentation surfaces 11, 12 of the stand column. The column of FIG. 2 may be folded up on itself by flapping the boards 4, 5 together.

The starting panel (FIG. 3), which is rectangular, has two free lateral borders 13, 14 and two transverse borders 15, 16. Starting from the lateral borders 13, 14, lateral flap portions 17, 18 have been formed beyond two folding lines 19, 20 in order to secure elastic bands which will be discussed hereinafter.

In the end regions of the folding lines 6, the flaps 17, 18 are indented in order to allow the boards 4, 5 to be folded together. Each flap has another pair of central indentations 21, 22 to let through and receive the elastic bands. The flaps 17, 18 are flapped onto the internal surfaces of the boards 4, 5 adjacent to them such that the folding lines 19, 20 become the free borders of the panel parts 2, 3.

The two singular panel parts 2, 3 of the stand of FIGS. 1-3 which are articulated about the edge 7 are end panels. The widths of the two panels 2, 3 are different. Laid flat and with the two panels flapped together (FIG. 1), the two free borders 19, 20 of the two panels are spaced apart, i.e., separated.

The flaps 17, 18 are linked in pairs and facing each other and an elastic band 23 is slid into the four central indentations 21, 22 of the flaps 17, 18, of each pair of linked flaps.

When the stand is laid flat, with the two panels flapped together, the elastic bands 23 are strained in extension. In other words, the laying-flat operation takes place counter to the action of the elastic bands 23.

Under the action of the elastic bands 23, the two free borders 19, 20 are pulled together and they approach one another until they are approximately coincident, the linked flaps being paired together, flattened and held against each other between the two panels 2, 3, which in this case are both of the end panels. In this set-up state of the stand, because of the different widths of the two panels, the wider panel 2 bulges out (FIG. 2). The stand is thus perfectly set up and may be erected on its base consisting of one of the two transverse borders with the rectilinear part (of the narrower panel 3) and with the curvilinear part (of the wider panel 2). The flaps 17, 18 are located inside the volume thus created and are invisible. The exterior appearance of the display stand is attractive and its useful presentation area, all things otherwise being equal, is larger than that of prior art display stands.

Since the column 1 is folded up on itself, in order to erect it the boards 4, 5 which are flapped together about the folding lines 6 are unfolded and, under the action of the elastic bands 23, it assumes the state shown in FIG. 2. In order to collapse it, it is laid flat again counter to the action of the elastic bands 23 and then the boards 4, 5 are flapped together.

Figure 4:
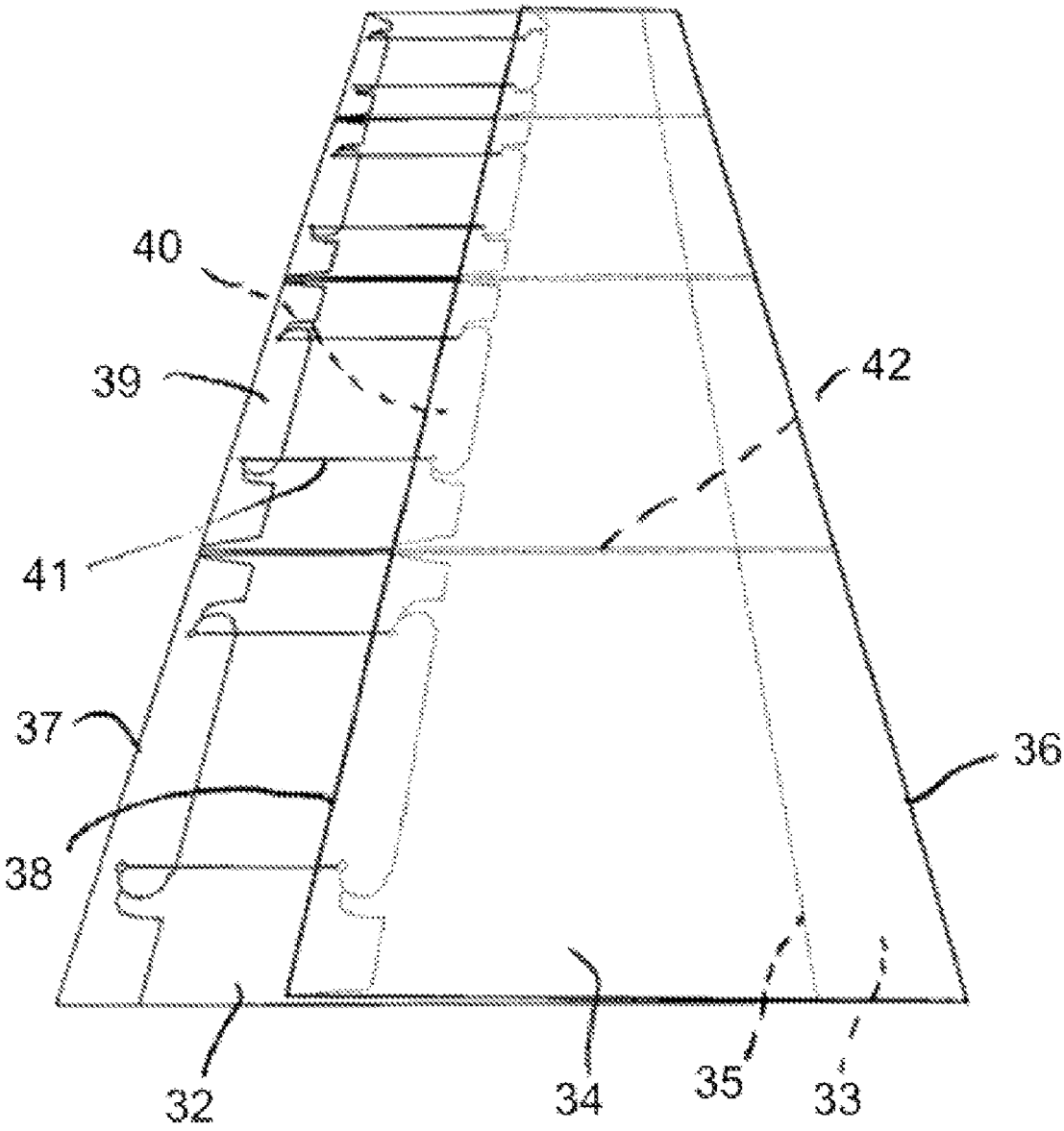
FIG. 4 shows a perspective view of a second embodiment of the stand of the invention having three articulated panels, laid flat.
Figure 5:
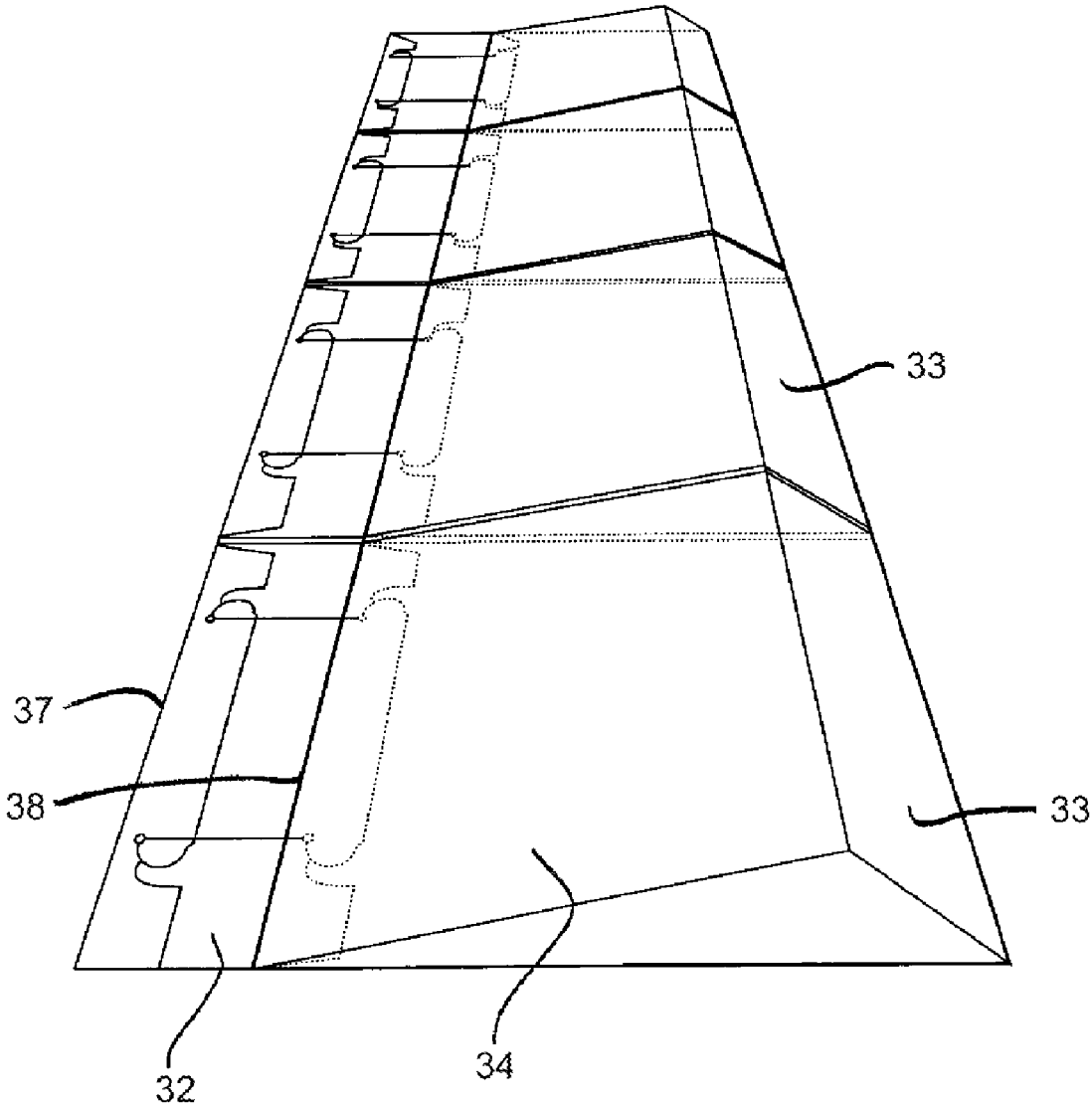
FIG. 5 shows a perspective view of the stand of FIG. 4 as it is being set up.
Figure 6:
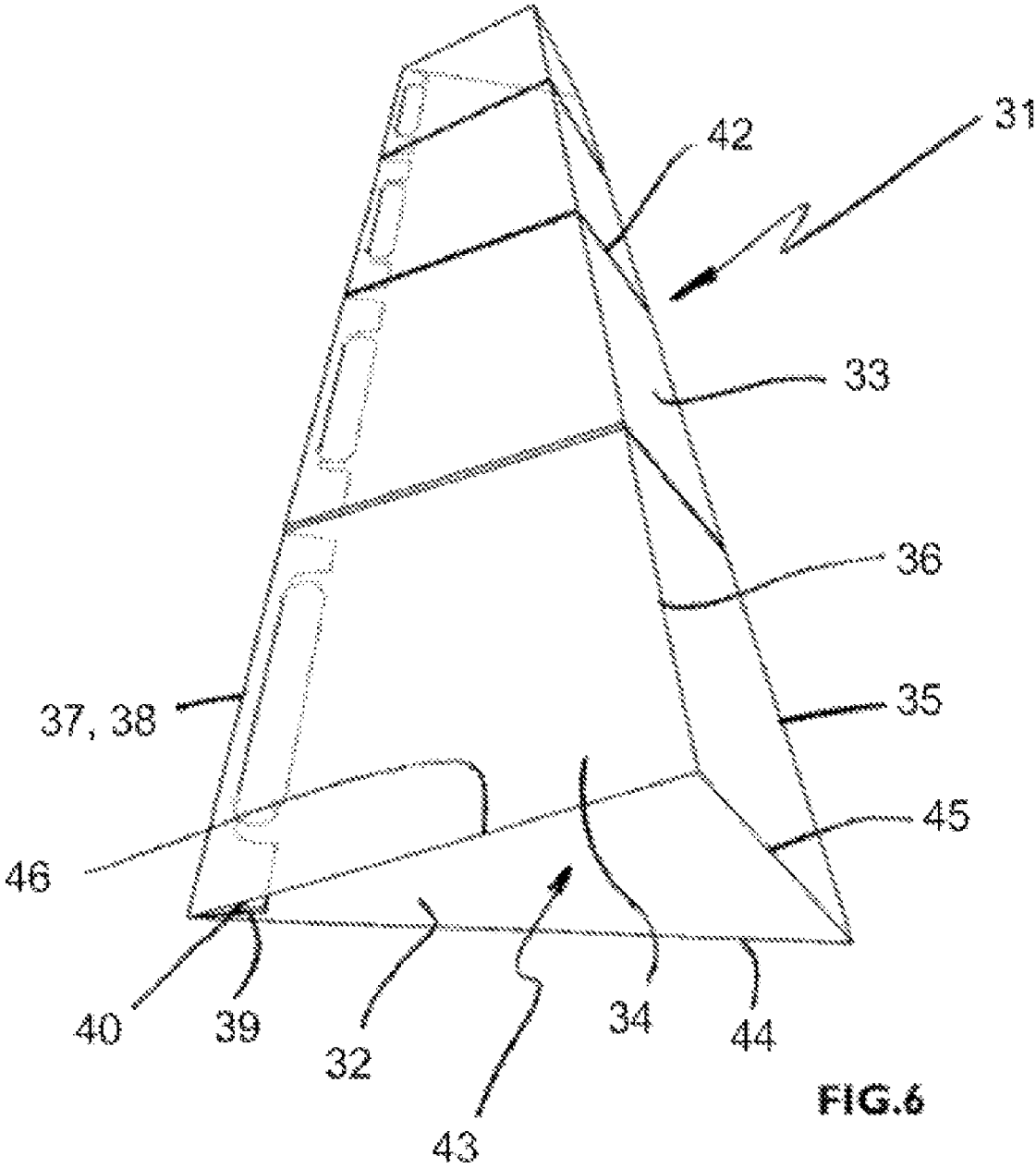
FIG. 6 shows a perspective view of the stand of FIGS. 4 and 5 in the set-up state.

The display stand 31 of FIGS. 4-6 differs from that of the preceding figures in that it comprises, still with just a singular starting panel, three panel parts 32, 33, 34, namely two end panels 32, 34 and one central panel 33 delimited by two folding or articulation edges 35, 36 parallel to the two free borders 37, 38 of the two panel parts 32, 34. Flaps 39, 40 for securing elastic bands 41 and linked in pairs are articulated along the free borders 37, 38, as in the preceding embodiment.

The width of each end panel 32, 34 is again different from the sum of the widths of the other two panels 33, 34-32, 33. In one embodiment, the width of the end panel 32, between the articulation edge 35 and the free border 37, is less than the sum of the widths of the other two panels 33, 34 as can easily be seen in FIG. 4.

Once the boards of the panel parts that were flapped together have been unfolded about the folding lines 42, the stand 31, under the action of the elastic bands 41, is set up so that it can be erected on a triangular erection/bearing base 43 (FIG. 6) then sides of which consist of the contiguous transverse borders 41-46 of the three panel parts 32-34.

In the dismantled, laid-flat position shown in FIG. 4, the two free borders 37, 38 of the stand are spaced apart, i.e., separated, from one another with the elastic bands 41 being strained. Under the action of these elastic bands, the stand begins to take on form, the free borders 37, 38 beginning to approach one another (FIG. 5) before coinciding with each other in the perfectly set-up erected state (FIG. 6) in which the flaps 39, 40 are still inside the volume created, shielded from the view of consumers and thus freeing up a large presentation area.

Figure 7:
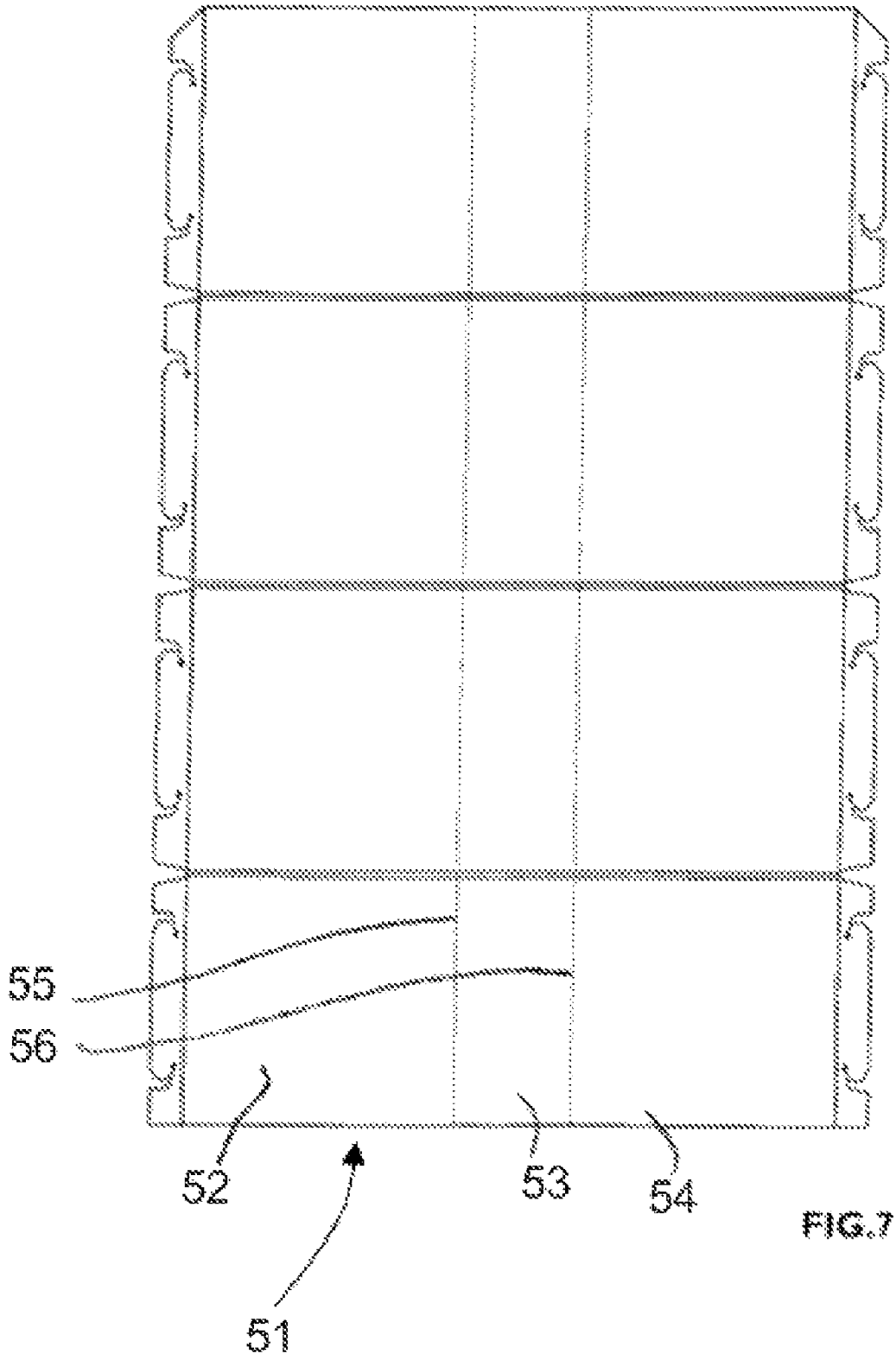
FIG. 7 shows a plan view of a third embodiment of the stand of the invention in the opened-out state and laid flat.

The display stand 51 of FIG. 7 is similar to that of FIGS. 4-6. The only difference is in the width of the two end panel parts 52, 54, which is the same. The two end panel parts 52, 54 surround a central panel part 53 between the two articulation lines 55, 56, the three parts of the panel being formed from a singular panel.

Figure 8:
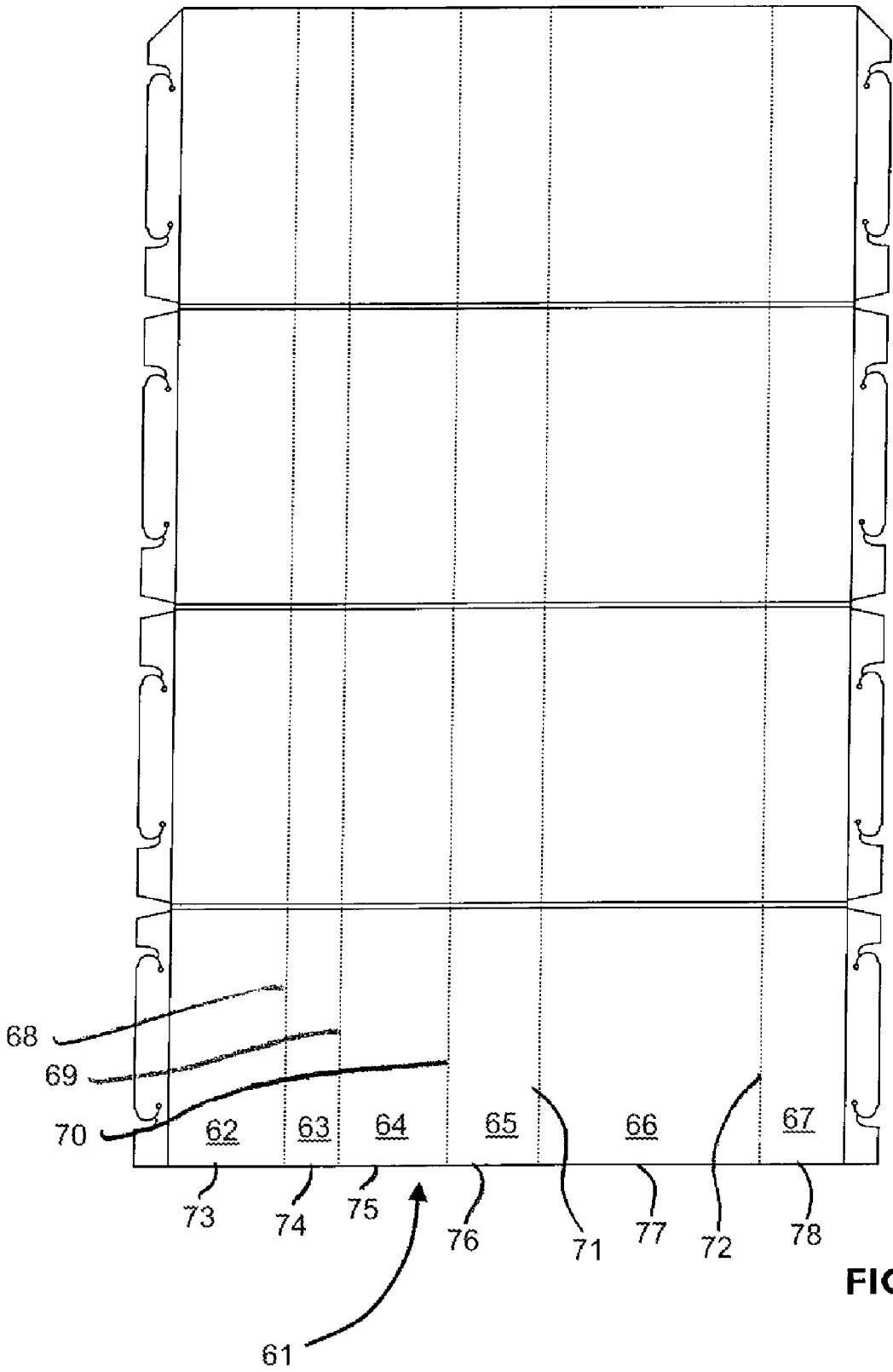
FIG. 8 shows a plan view of a fourth embodiment of the stand of the invention in the opened-out state and laid flat.

As for the display stand 61 of FIG. 8, this differs from the preceding panels in that, starting again from a singular panel, it comprises six adjacent panel parts 62-67 connected by five articulation and folding edges 68-72. In this case again, the width of each end panel part 62, 67 is different from the rest of the opened-out width of the panel 61.

In the set-up state, the transverse borders 73-78 of the panel parts 62-67 form a polygonal base with six sides.

The invention claimed is:

1. Stand for displaying information having at least one presentation surface, comprising a plurality of panels made of a substantially rigid material and articulated together in an articulation direction, having two end panels each extending between an articulation edge and a free border substantially parallel to the articulation edge, each of the two end panels being extended by flaps for securing an elastic return means comprising elastic bands, these flaps being articulated at the free border and flapped inwards such that, when the stand is set up, the flaps for securing the two end panels are abutted against each other between the two end panels, the stand being able to be laid flat counter to the action of said elastic return means with the two flaps and the two free borders of the two end panels being separated from one another and the panels thus being able to be folded on themselves, the elastic return means being arranged in order, after the panels have been unfolded, to bring the two free borders together, so as to be approximately coincident, and thus to set up the stand, the width of one of the end panels between its articulation edge and its free border being different from the rest of the opened-out width of the stand.

2. The stand according to claim 1, in which as many flaps, articulated to each end panel free border and flapped inwards against this end panel, are provided as there are panels able to be flapped together.

3. The stand according to claim 1, in which two articulated panels having different widths are provided.

4. The stand according to claim 1, in which three panels are provided.

5. The stand according to claim 4, in which the width of each end panel is less than the sum of the widths of the other two panels.

6. The stand according to claim 5, in which the two end panels have the same width.

7. The stand according to claim 1, which, when setup, is erected so as to bear on a polygonal base.

8. The stand according to claim 1, in which the elastic return means comprise as many elastic bands secured to flaps as there are panels able to be flapped together.

9. The stand according to claim 1, in which the elastic return means comprise a single elastic band.

10. The stand according to claim 1, in which the panels are obtained after folding a singular panel along one or two articulation edges.

11. The stand according to claim 1, wherein each flap extends between the free border of the adjacent end panel and a free lateral border, wherein the two free lateral borders are separated from one another when the stand is laid flat counter to the action of the elastic return means.

12. The stand according to claim 11, wherein each flap further comprises a pair of indentions extending from said free lateral border to let through and receive the elastic return means.

13. The stand according to claim 1, wherein said end panels share an articulation edge.

* * * * *